US008369911B2

(12) United States Patent
Moser et al.

(10) Patent No.: US 8,369,911 B2
(45) Date of Patent: Feb. 5, 2013

(54) SINGLE-COIL SUPERCONDUCTING MINIUNDULATOR

(75) Inventors: Herbert O. Moser, Singapore (SG); Caozheng Diao, Singapore (SG)

(73) Assignee: National University of Singapore, Singapore (SG)

( * ) Notice: Subject to any disclaimer, the term of this patent is extended or adjusted under 35 U.S.C. 154(b) by 0 days.

(21) Appl. No.: 13/063,772

(22) PCT Filed: Sep. 14, 2009

(86) PCT No.: PCT/SG2009/000338

§ 371 (c)(1), (2), (4) Date: Mar. 14, 2011

(87) PCT Pub. No.: WO2010/030250

PCT Pub. Date: Mar. 18, 2010

(65) Prior Publication Data

US 2011/0172104 A1 Jul. 14, 2011

Related U.S. Application Data

(60) Provisional application No. 61/192,059, filed on Sep. 15, 2008.

(51) Int. Cl.
*H01B 12/00* (2006.01)

(52) U.S. Cl. ..... 505/211

(58) Field of Classification Search ..... 505/211; 335/216
See application file for complete search history.

(56) References Cited

U.S. PATENT DOCUMENTS 7,129,807 B2 * 10/2006 Rossmanith et al. ..... 335/216
8,134,440 B2 * 3/2012 Beckenbach et al. ..... 335/299

FOREIGN PATENT DOCUMENTS

DE 41 01 094 C1 5/1992

OTHER PUBLICATIONS

International Search Report dated Nov. 10, 2009.
T. Hezel et al., "Conceptual and Experimental Feasibility Study of a Superconductive Micro-Undulator", *Proceedings of the 1997 Particle Accelerator Conference*, 3:3512-3514 (1997).
Ben-Zvi et al., "The performance of a superconducting micro-undulator prototype4", *Nuclear Instruments and Methods in Physics Research*, A297:301-305 (1990).
A. Geisler et al., "A Superconducting Short Period Undulator", *Proceedings of the 2001 Particle Accelerator Conference*, 1:233-235 (2001).

* cited by examiner

*Primary Examiner* — Colleen Dunn
(74) *Attorney, Agent, or Firm* — Ostrolenk Faber LLP

(57) ABSTRACT

A miniundulator that includes a first bobbin and a second bobbin parallel to and spaced from the first bobbin, and a superconductive wire wound around the outer surfaces of the first bobbin and the second bobbin, and method for the assembly of the miniundulator are disclosed.

24 Claims, 7 Drawing Sheets

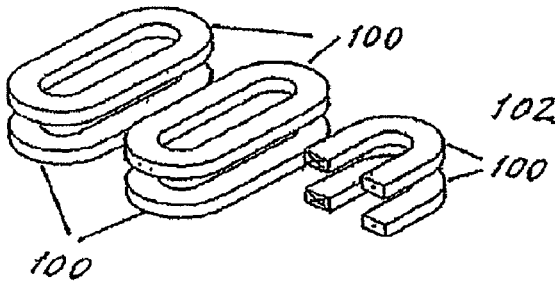
FIG. 1A
PRIOR ART
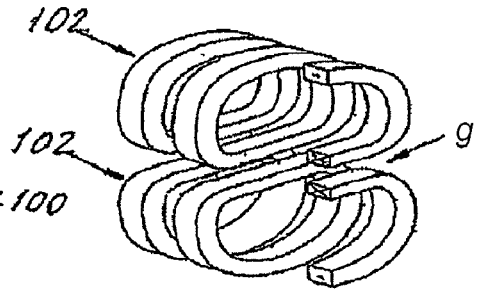
FIG. 1C
PRIOR ART
FIG. 1B
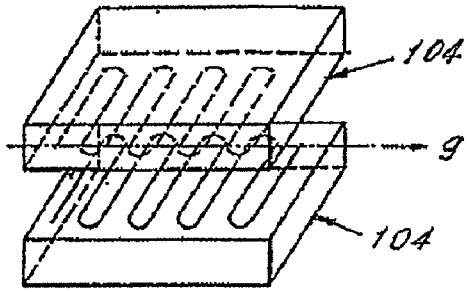
PRIOR ART
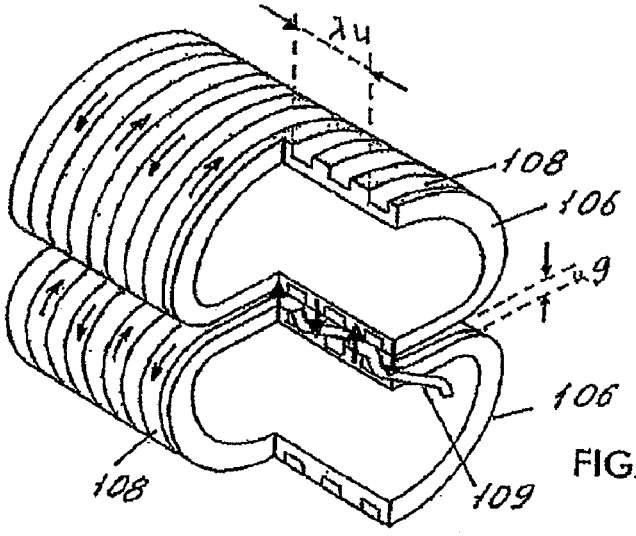
FIG. 2
PRIOR ART

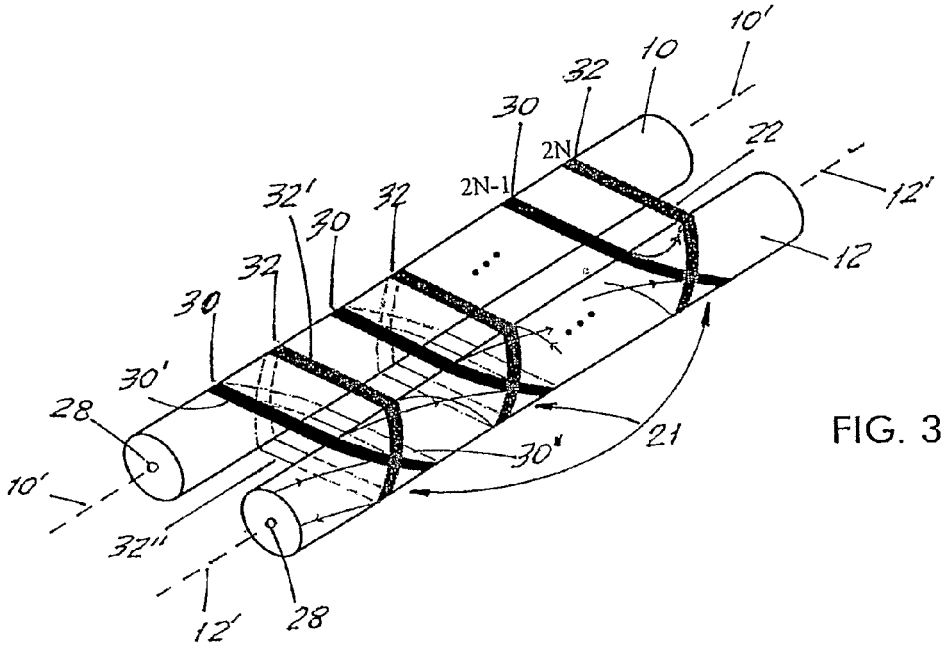
FIG. 3C
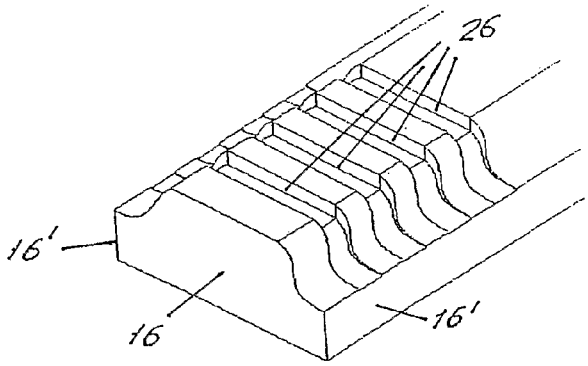
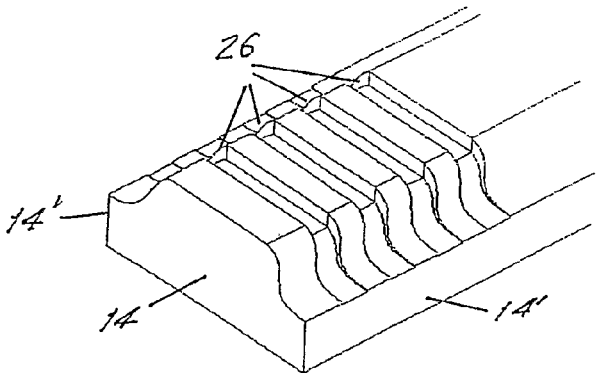

SINGLE-COIL SUPERCONDUCTING MINIUNDULATOR

CROSS REFERENCE TO RELATED APPLICATION

The present application is a 35 U.S.C. §371 National Phase conversion of PCT/SG2009/000338, filed Sep. 14, 2009, which claims benefit of U.S. Provisional Application Ser. No. 61/192,059, filed Sep. 15, 2008, entitled SINGLE-COIL SUPERCONDUCTING-MINIUNDULATOR, to which claims of priority are hereby made and the disclosures of which are incorporated by reference herein.

FIELD OF THE INVENTION

The present application relates to superconducting miniundulators.

BACKGROUND OF THE INVENTION

Light has been the probe of choice to investigate and modify properties of matter. The development of ever more powerful light sources is the key to sustained progress in that field. Besides lasers, synchrotron radiation has played a growing role since the 1970s. The undulator is the predominant source type employed in the modern 3rd and 4th generation synchrotron light sources and Free Electron Lasers (FEL). Undulators are magnetic devices that generate a spatially periodic magnetic field variation that causes a charged particle beam, usually electrons, to emit electromagnetic radiation with special properties. Undulators are the prime magnetic devices for the generation of highly brilliant synchrotron light by the 3rd and the 4th generation light sources. The development of undulators with higher magnetic field and smaller magnetic period in the mm range is an important technical problem under study currently. The motivation to build such miniundulators is to produce harder radiation for a given beam energy or to save accelerator cost by using a lower electron energy for a given photon energy.

In principle, short period undulators can be built in various ways: they can be Halbach-type undulators with permanent magnets, hybrid-type undulators, or the so-called electromagnetic undulators. In Halbach-type undulators and hybrid undulators, the maximum field is mainly defined by the material properties of the rare earth magnets and, to a certain extent, by the specific design details. They are difficult to build with high peak field when the period length is in the mm-region. Electromagnetic undulators have the disadvantage that both the required currents as well as the Ohmic losses are relatively high. The use of superconductors instead of normal conductors reduces the Ohmic losses to a negligible amount. For this reason, around 1990, both Brookhaven (Ben-Zvi, Z. Y. Jiang, G. Ingold and L. H. Yu, *Nucl. Instrum. Methods*, A 297, 301 (1990)) and Karlsruhe (H. O. Moser, B. Krevet and H. Holzapfel, Forschungszentrum Karlsruhe, German Patent P 41 01 094.9-33, Jan. 16, 1991) presented different proposals to replace the permanent magnets by superconducting wires or striplines in order to increase the field strength of the undulators. They combined the advantages of superconductivity and in vacuo design, and it was demonstrated that the field strength with superconducting undulators can be significantly higher in comparison with conventional undulators.

Superconducting miniundulators have the potential to overcome some limitations of conventional undulators. They are expected to play an important role in upgrade projects of 3rd generation sources and FELs. In the past, there has been considerable progress in developing superconducting miniundulators at several places.

Up-to-date three different superconducting coil arrangements have been used for a planar superconducting undulator. The general design goal is to reduce undulator period length as much as possible while maintaining its undulator parameter K close to 2 in the interest of tunability. K is given as $$K=0.934B_0[T]\lambda_u[\text{cm}] \quad (1)$$

with $B_0$ the peak field on axis in Tesla and $\lambda_u$ the undulator period length in cm. As long as the K parameter can go up to 2, the undulator is fully tunable which means that the whole range from its fundamental frequency to say $7^{th}$ or even higher harmonics can be scanned.

Referring to FIG. 1A, in one superconducting coil arrangement, a superconducting solenoid is cut in two identical shorter solenoids 100, and the shorter solenoids are pulled apart to get a so-called split-pair solenoid. A number of split-pair solenoids are then placed next to each other with alternating field direction in a row to obtain the spatially alternating field of an undulator. In an undulator according to FIG. 1A, the particle beam travels perpendicularly to the solenoid axis through the gap created by splitting the solenoids. However, this concept cannot be easily miniaturized. Referring to FIG. 1B, another approach is to realize a meandering current path in one plane (slab) 104 and arranging two such slabs opposite one another and separated by a small gap, in which the spatially alternating field is generated. This design can be implemented in micro manufacturing and, thus, is a way to realize micrometer scale period length.

Referring to FIG. 1C, in yet another solution, two solenoids 102 are wound bifilarly (pair of conductors with opposite current direction) and placed parallel to one another with a small gap therebetween. In this arrangement, the magnetic field vanishes more or less within solenoids 102 and also far away because of the opposite current direction. But, in the immediate neighborhood at the outside surface of solenoids 102, in particular, between the solenoids in the gap g, the field is strong. The cross section of solenoids 102 in this case is no longer circular; it has at least one almost straight section which forms the gap for the particle beam. Rather short periods are possible with this set up. In this design, the particle beam travels in the gap parallel to the axis of the two solenoids 102 and the peak field is high compared to permanent magnet set-ups and scales with the gap g.

FIG. 2 depicts a 3-D schematic of the superconducting miniundulator based on the design shown by FIG. 10. The design consists of two ferromagnetic cores 106 with superconducting coils 108 that are placed symmetrically with respect to the midplane of the superconducting undulator in which a particle beam 109 travels. The flat sides of cores 106 adjacent to the midplane are the top and bottom undulator poles. Each core 106 includes grooves for receiving a respective superconducting coil 108. The design of FIG. 2 allows for the application of two types of beam vacuum systems. In the case of low power single-pass beams, the beam can share the vacuum with the superconducting coils. In the case of storage rings in which the electron beam chamber vacuum needs to be of the order of $10^{-9}$ mbar, a shared insulation and beam vacuum is excluded due to materials like the insulation of superconducting wires and the many cryogenic structural materials. So the beam should use a separate vacuum chamber, typically with an elliptical cross section, that will be inserted in the gap between the poles. The superconducting coils 108 need to be maintained at temperatures around 4 K when conventional superconducting wires made of NbTi are used. For other superconducting wire materials, in particular, for high $T_c$ superconductors, higher temperatures may be exploited, e.g., around the temperature of liquid nitrogen 77 K. The most straightforward solution for the cooling of medium size superconducting undulators is the usage of liquid helium. Another solution is cryogen-free cooling, which is based on commercially available two-stage cryocoolers and massive copper leads to connect the cold head of the cryocooler with the coil to be cooled.

A well known superconducting material for coils 108 is NbTi. Moreover, some laboratories have done prototyping work with $Nb_3Sn$ in order to benefit from the higher critical current. Compared to NbTi, a magnetic field increase by about 30-50% is expected from $Nb_3Sn$ conductors. Other superconductors are being observed for their suitability, in particular, high $T_c$ superconductors. Normally, a rectangular wire will be used for coils 108 instead of a round wire, because a larger packing factor and better control of the wire positioning in the grooves can be achieved.

SUMMARY OF THE INVENTION

A miniundulator according to the present invention is characterized by having one coil preferably wound from a single superconductive wire for producing the magnetic field that undulates the electron beam and includes a first bobbin having a first longitudinal axis, a second bobbin spaced from the first bobbin and having a second longitudinal axis, and a superconductive wire wound around outer surfaces of the first bobbin and the second bobbin to define a plurality of coil sections arranged along the first and the second longitudinal axes. In the existing planar superconducting miniundulators, the coils are oriented perpendicularly to the direction of the propagation of the beam and the space provided for the transmission of the beam is outside the coils. In a miniundulator according to the present invention, the space for the transmission of the beam is inside one coil.

According to one aspect of the present invention, the coil sections include a first coil section lying along a first plane that intersects the first longitudinal axis and the second longitudinal axis at an angle other than 90 degrees, and a second coil section lying along a second plane that intersects the first longitudinal axis and the second longitudinal axis at an angle other than 90 degrees, wherein the first plane and the second plane intersect one another, and the first coil section and the second coil section cross one another on the outer surfaces of the first bobbin and the second bobbin. It should be noted that all coil sections are continuously wound from one superconductive wire.

In the preferred embodiment, the coil sections include a first group of first coil sections each lying along a respective first plane that intersects the first longitudinal axis and the second longitudinal axis at an angle other than 90 degrees, and a second group of second coil sections each lying along a second plane that intersects the first longitudinal axis and the second longitudinal axis at an angle other than 90 degrees, wherein each first coil section crosses a respective second coil section on the outer surfaces of the first bobbin and the second bobbin.

According to another aspect of the present invention, the first coil section and the second coil section each includes a top portion lying on a top plane and a bottom portion lying on a bottom plane that is parallel to the top plane, the top sections being parallel to one another and the bottom sections being parallel to one another.

According to yet another aspect of the present invention, the top portion of the first coil section is disposed above the bottom portion of a respective second coil section and the top portion of the second coil section is disposed above the bottom portion of the first coil section.

Preferably, each coil section may comprise a plurality of windings of the superconductive wire, the windings being arranged in layers, wherein each layer includes a plurality of laterally arranged windings.

In the preferred embodiment, each bobbin includes a bore in the body thereof configured for the reception of a cooler. Note that the required cooling depends on the superconductive material of the superconductive wire. The cooler may be a cooling fluid such as liquid helium or a copper body or the like that is thermally coupled to a cooling source to cool the bobbins to the temperature of liquid helium (i.e. 4K). If the superconductive wire is formed with a high $T_c$ superconductor, higher temperatures may be exploited, e.g., around the temperature of liquid nitrogen (77 K). The superconductive wire used in a miniundulator according to the present invention may be made from NbTi, or $Nb_3Sn$, or any other suitable material, and may have a rectangular cross-section.

According to another aspect of the present invention, the miniundulator may further include a plurality of pole pieces, the pole pieces being arranged opposite one another, in contact with the coil sections, and extending between the first bobbin and the second bobbin, wherein the pole pieces and the bobbins define a space in the interior of the coil sections configured for the passage of a particle beam. A plurality of clamps can be used to secure the pole pieces around the bobbins.

In the preferred embodiment, both pole pieces include a plurality of grooves each for receiving a coil section. The pole pieces and the bobbins define a beam cavity for the passage of a beam, the beam cavity including a first dimension defined by the distance between the bobbins and a second dimension defined by a distance between the pole pieces, wherein the second dimension is less wide than the thickness of the bobbins.

To assemble a miniundulator according to the present invention, a first bobbin and a second bobbin are positioned parallel to one another by a distance, a superconductive wire is wound over the outer surfaces of the first bobbin and the second bobbin by rotating the first and the second bobbin about a common axis, and the wire is moved in a direction parallel to the common axis while rotating the bobbins. In the preferred embodiment, both bobbins include guiding grooves on the outer surface thereof, the wire being received in and aligned by the guiding grooves. In the preferred embodiment, the bobbins are rotated clockwise to obtain a plurality of first coil sections aligned parallel to a plane that lies along a first direction, and rotated in a counterclockwise direction to obtain a plurality of second coil sections aligned parallel to a plane that lies along a second direction, wherein each first coil section is crossed by a respective second coil section. In one preferred embodiment, a parallelogram, articulating jig may be used to keep the bobbins aligned and to set the distance between the bobbins.

According to one aspect of the present invention the superconductive wire is a continuous, uninterrupted wire resulting in a single coil, superconducting miniundulator. Compared to the existing superconducting miniundulator, the miniundulator according to the present invention is much more compact which translates to reduced complexity, size, weight, and cost. Applications for this kind of superconducting miniundulators reside in synchroton radiation facilities of which there are about 70 worldwide with an annual growth of about 1.6 facilities.

Other features and advantages of the present invention will become apparent from the following description of the invention which refers to the accompanying drawings.

BRIEF DESCRIPTION OF THE DRAWING(S)

FIG. 1A schematically illustrates a prior art miniundulator arrangement.

FIG. 1B schematically illustrates another prior art miniundulator arrangement.

FIG. 1C schematically illustrates yet another prior art miniundulator arrangement.

FIG. 2 schematically illustrates a variation of the prior art miniundulator arrangement illustrated by FIG. 1C.

FIG. 3C depicts parts of a disassembled miniundulator according to the preferred embodiment of the present invention.

Figure 8:
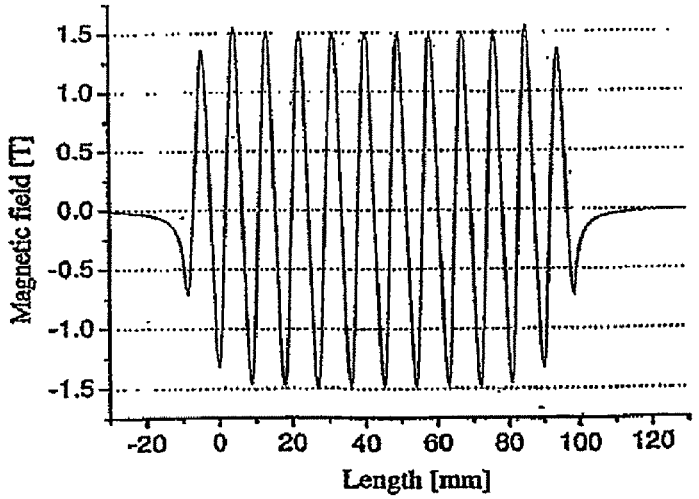

FIG. 8 graphically illustrates calculated values for the magnetic field along the midplane of a miniundulator according to the present invention.

DETAILED DESCRIPTION OF EMBODIMENTS OF THE INVENTION

Referring to FIGS. 3A-3E, a superconducting miniundulator according to a preferred embodiment of the present invention includes a first bobbin 10, a second bobbin 12, a first pole piece 14, a second pole piece 16, a first clamp 18, a second clamp 20, and a single superconductive coil 21 formed with a wound superconductive wire 22. First bobbin 10 and second bobbin 12 are elongated bodies each having a longitudinal central axis 10', 12' extending along the length thereof. The longitudinal axis 10', 12' of bobbins 10, 12 are parallel to one another and bobbins 10, 12 are spaced from another by a distance. Note that while, in the preferred embodiment, bobbins 10, 12 are cylinders having a generally circular cross-section transverse to the longitudinal axes thereof, other shapes may be used without deviating from the scope and spirit of the present invention.

Figure 3A:
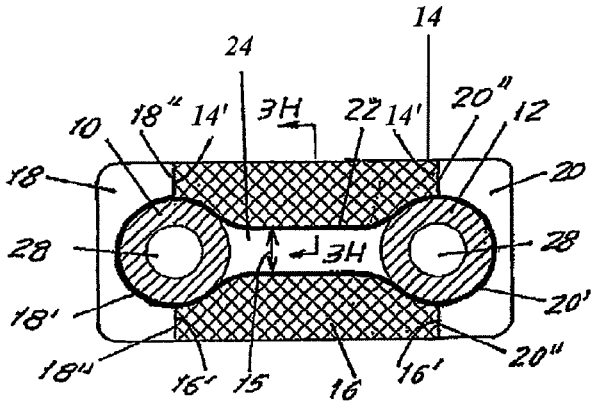
FIG. 3A depicts a front plan view of a miniundulator according to a preferred embodiment of the present invention.
Figure 3B:
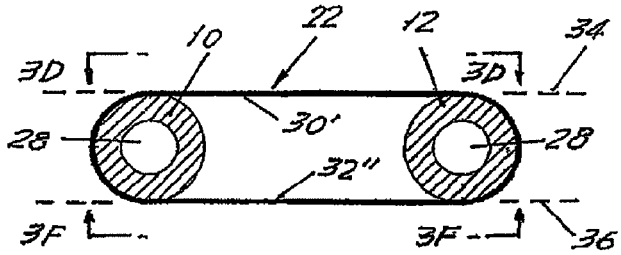
FIG. 3B depicts a front plan view of a part of the miniundulator according to the present invention.
Figure 3D:
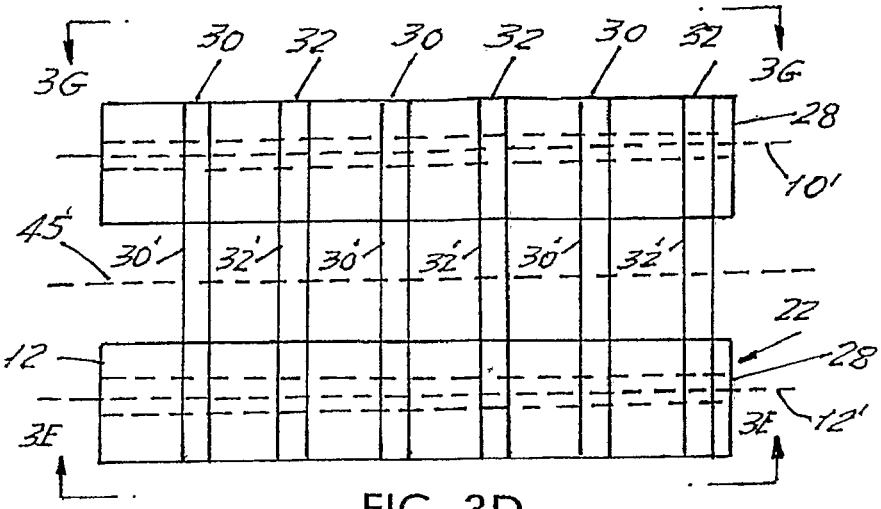
FIG. 3D depicts a top plan view of a miniundulator according to the present invention viewed in the direction of arrows 3D-3D in FIG. 3B.
Figure 3E:
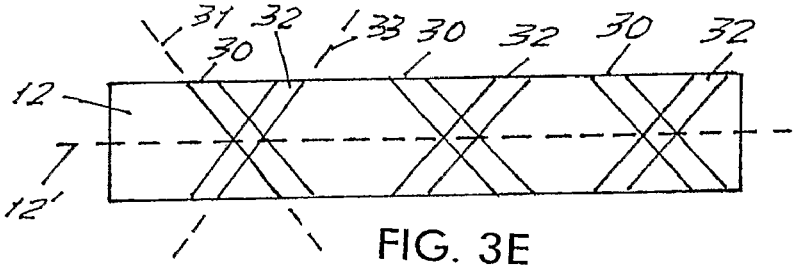
FIG. 3E depicts a side plan view of a miniundulator according to the present invention viewed in the direction of the arrows 3E-3E in FIG. 3D.
Figure 3F:
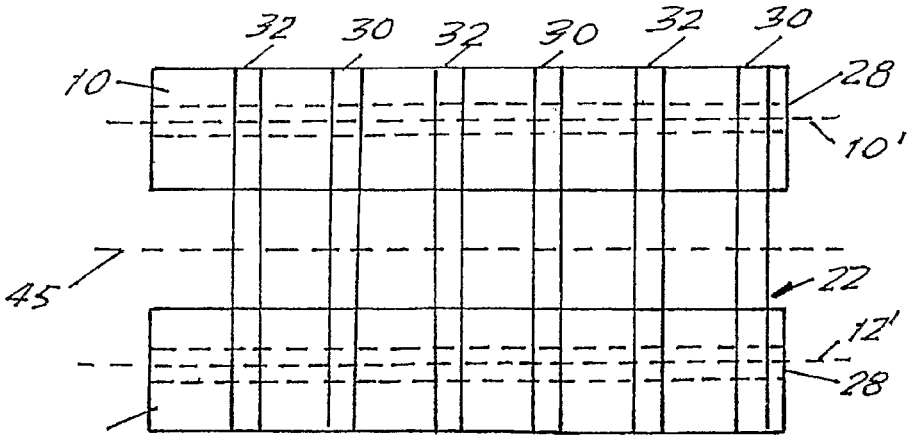
FIG. 3F depicts a bottom plan view of a miniundulator according to the present invention viewed in the direction of arrows 3F-3F in FIG. 3B.
Figure 3G:
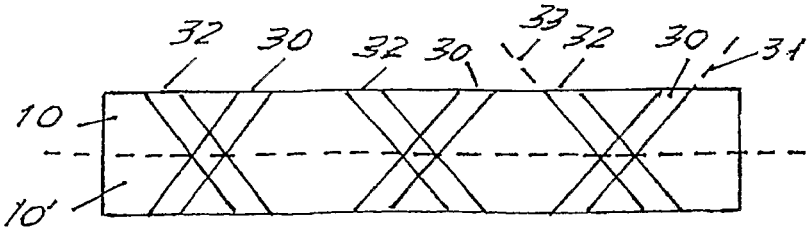
FIG. 3G depicts a side plan view of a miniundulator according to the present invention viewed in the direction of the arrows 3G-3G in FIG. 3D.

Referring specifically to FIGS. 3B-3G, according to one aspect of the present invention, coil 21 (see FIG. 3C) is made from a single piece, uninterrupted, continuous superconductive wire 22 that is wound around the outer surfaces of bobbins 10, 12 forming a cylinder having a racetrack-shape cross-sectional profile transverse to the longitudinal axis thereof ("racetrack can"). According to one aspect of the present invention, wire 22 is wound to obtain a plurality of coil sections 30, 32 arranged along the length of bobbins 10, 12. It should be noted that each coil section 30, 32 is parallel to a respective plane that passes through longitudinal axes 10', 12' at an angle other than 90°. Specifically, each first coil section 30 in a group of first coil sections 30 lies parallel to a first plane 31 and each second coil section 32 in a group of second coil sections 32 lies parallel to a second plane 33, which intersects a nearby first plane. Consequently, each first coil section 30 is crossed by (or crosses) a respective second coil section 32 on the outer surfaces of bobbins 10, 12. Note that each coil section 30, 32 includes a top portion 30', 32', and a bottom portion 30", 32". Preferably, before the assembly of pole pieces, 14,16, top portions 30', 32' are coplanar, lie parallel to a first plane 34 (see FIG. 3B) and are parallel to one another, while bottom portions 30", 32" are coplanar, parallel to one another and lie parallel to a second plane 36 (see also FIG. 3B), which is parallel to first plane 34. Because of the orientation of coil sections 30, 32, the top portion 30', 32' of each coil section 30, 32, while parallel with its bottom section, does not lie directly below the same. Rather, the coil sections are arranged such that the top portion 30', 32' of one of the coil sections 30, 32 is directly above the bottom portion 30", 32" of the coil section that crosses it. Thus, top portion 30' of a first coil section 30 is directly above bottom portion 32" of a second coil section 32 that crosses the same, and top portion 32' of second coil section 32 is directly above bottom portion 30" of a coil section 30 that is crossed by second coil section 32. This arrangement can be repeated as many times as desired along the length of bobbins 10, 12. Thus, N number of first coil sections 30 and N number of second coil sections 32 result in 2N number of total coil sections. Note that when current is provided to wire 22, top portions 30', and bottom portions 32" will conduct current in one direction, while bottom portions 30", and top portions 32' will conduct current in the opposite direction. Consequently, top portion 30' of a first coil section 30 and bottom portion 32" of a crossing second coil section 32 will have current travelling therethrough in the same direction, while top portion 32' of the second coil portion 32 and bottom portion 30" of first coil portion 30 will have current travelling therethrough in the same direction, but opposite to that mentioned in the first half of the sentence. As a result, a spatially variable magnetic field is generated inside the interior of each coil sections 30, 32. Referring to FIG. 3D, in a miniundulator according to the present invention, a period would extend, e.g., from the left edge of a coil section 30 going to the right over the coil section 32 to the left edge of the next coil section 30. In the preferred embodiment, superconductive wire 22 is wound such that portions 30', 30", 32', 32" thereof that pass over and under the space between bobbins 10, 12 are parallel to one another and transverse to the direction of elongation of longitudinal axes 10', 12' of bobbins 10, 12.

Figure 3H:
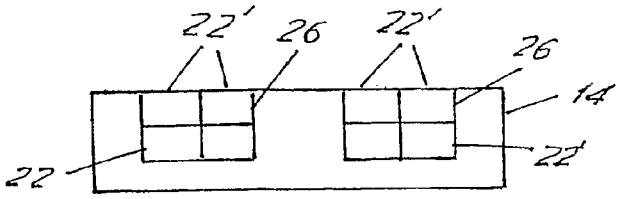
FIG. 3H is a cross-sectional view along line 3H-3H in FIG. 3A viewed in the direction of the arrows.
Figure 3I:
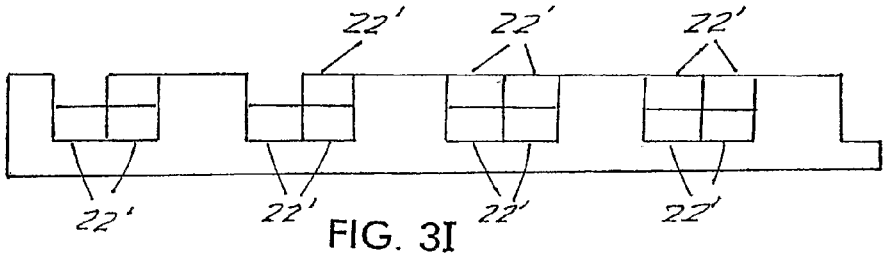
FIG. 3I is a cross-sectional view of the preferred embodiment illustrating the differences in the number of windings in the coil sections at the end of a miniundulator according to the present invention.

According to an aspect of the present invention, pole pieces 14, 16 are arranged to press the parallel sections 30', 30", 32', 32" to reduce the distance therebetween. Note that, pole pieces 14, 16 define a cavity 24 which extends longitudinally parallel to longitudinal axes 10', 12' of bobbins 10, 12 and serves as a path for a charged beam (e.g. an electron beam). As a result, and according to the present invention, the charged beam travels inside superconductive coil sections 30, 32 of coil 21 that is defined by winding a superconductive wire 22 around bobbins 10, 12. Note that, in the preferred embodiment, each pole piece 14, 16 includes a plurality of parallel, and spaced grooves 26. Each groove 26 is deep enough to receive a respective portion 30', 30", 32', 32" of a respective coil section 30, 32. Referring to FIG. 3H, each coil section 30, 32 may include a plurality of winding 22' disposed adjacent one another as illustrated by FIG. 3D. Each winding 22' is at least one turn of wire 22 around bobbins 10, 12. Windings 22' may be arranged lateral to one another to constitute a winding layer. The layers of windings can be then vertically arranged to obtain a coil section. In a coil section, a wire is wound n (e.g. n=2) times to form a layer and m layers to form the whole coil cross section. Referring to FIG. 3I, in one embodiment, the number of windings at both ends (front and back) of the miniundulator may not be equal to the number of windings elsewhere. Thus, the last two coil sections may include three windings while the remaining coil sections may include four windings.

Note that each pole piece 14, 16 may include opposing and parallel recessed sides which are preferably curved to correspond to a portion of the outer surface of bobbins 10, 12. Clamp pieces 18, 20 may also include curved inner surfaces 18', 20' which correspond to respective portions of outer surfaces of bobbins 10, 12. In the preferred embodiment, clamps 18, 20 include abutting walls 18", 20", which abut the longitudinally extending sidewalls 14', 16' of pole pieces 14, 16. Clamp portions 18, 20 are secured to pole pieces 14, 16 and thus hold the arrangement together.

To attain the appropriate level of cooling, each bobbin 10, 12 is provided with a cooler 28 chamber, which may be a longitudinal bore that is coaxial with the central, longitudinal axis thereof. Cooler chamber 28 can be configured to receive a cooling fluid such as liquid helium or a copper heat transmitter which is coupled to a cryocooler to cool bobbins 10, 12 to the temperature of liquid helium, for example 4K.

Bobbins 10, 12 are made from non-magnetic material such as stainless steel or aluminum, wire 22 may be made from any superconductive material suitable for use in a miniundulator such as NbTi, $Nb_3Sn$, or any other suitable material such as high $T_c$ superconductors, which are predominantly cuprates from the perovskite family, e.g., YBCO (yttrium barium copper oxide). Pole pieces 14,16 may be made from iron or the like ferromagnetic material, and clamps 18,20 may be made from stainless steel.

Figure 4:
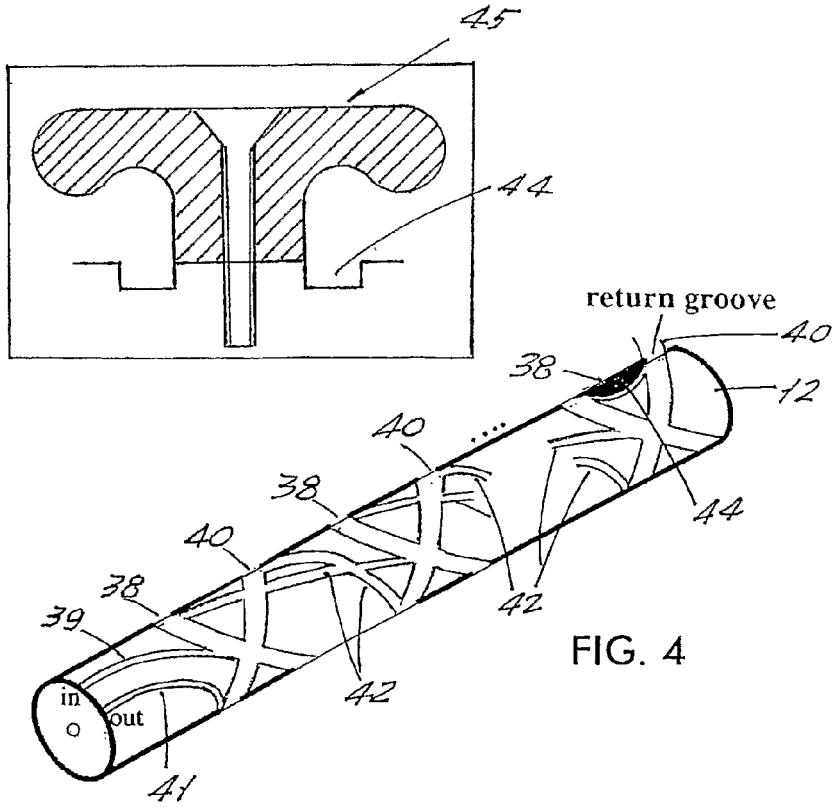
FIG. 4 illustrates side view of the outermost exterior surface of a bobbin that is used in a miniundulator according to the present invention.

Referring to FIG. 4, the outermost half of the exterior surface of second bobbin 12 includes a plurality of spaced guiding first grooves 38 and guiding second grooves 40. Guiding first grooves 38 are oriented along planes 31 and serve to align wire 22 to obtain first coil sections 30 along axis 12'. Similarly, guiding second grooves 40 are oriented along planes 33 and serve to align wire 22 to obtain second coil sections 32 along axis 12'. Note that each guiding first groove 38 is crossed by a respective guiding second groove 40, whereby the pattern of crossing first and second coil sections 30,32 can be realized. Small connecting grooves 42 also provide a path from one guiding first groove 38 to the next guiding first groove 38 along the length of bobbin 12. Similarly, connecting grooves 42 are provided to link guiding second grooves 40. Note that while guiding grooves 38,40 are made wide enough and deep enough to receive a plurality of windings 22' to realize a coil section, connecting grooves 42 may be relatively narrow enough and shallow enough for the passage of a single section of wire 22. A return groove 44 at the end of bobbin 12 provides a path from the last guiding first groove 38 along bobbin 12 to the first one of guiding second grooves 40. Thus, after the completion of the first winding phase, whereby first coil sections 30 are obtained, wire 22 is fed into guiding second grooves 40 to obtain second coil sections 32. A special removable nut 45 may be used to temporarily guide and confine wire 22 during the winding process along return groove 44. Nut 45 may be then removed after the wire is placed well in the guiding grooves. Preferably, the crossings of grooves 38,40 will be made deeper. Thus, for example, each first groove 38 may be made twice as deep at the location of its crossing a second guiding groove. It should be noted that first bobbin 10 may also include first guiding grooves 38 and second guiding grooves 40 on the outermost half of the exterior surface thereof each in alignment with a respective groove of the like kind on the outer surface of second bobbin 12. However, first bobbin 10 need not include connecting grooves 42 on the outer surface thereof. Thus, winding starts and ends on second bobbin 12.

Figure 5A:
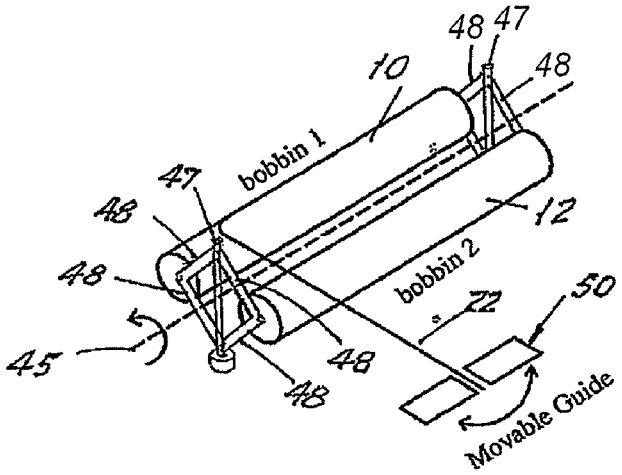
FIGS. 5A and 5B illustrate a set up and a method for the assembly of a miniundulator according to the present invention.
Figure 5B:
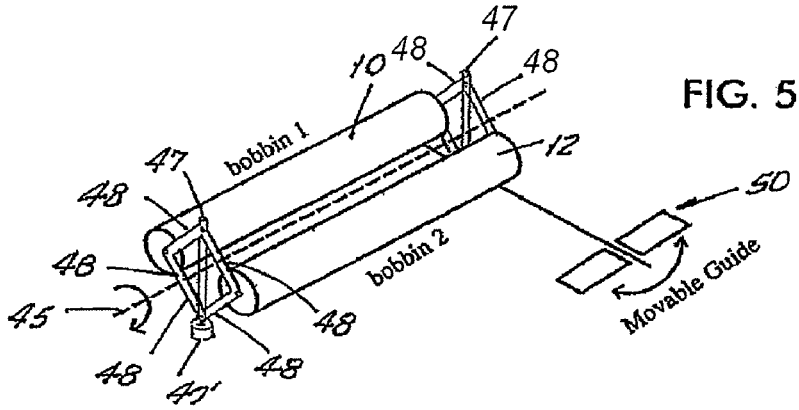

The following is a description of the process for winding wire 22 around bobbins 10, 12. According to one aspect of the present invention, the winding process will wind a single superconductive wire without any interruption to realize a coil 21. Superconducting wires are commercially available, for example, superconducting NbTi wire with a rectangular cross-section of 1.25 mm×0.8 mm as it is used in SSLS' conventional supramini prototype. The current density of such a wire is 1000 $A/mm^2$ corresponding to 70% of the critical current density. Preferably, there will be no sharp edges when winding a wire 22 on the cylindrical bobbins. Referring to FIGS. 5A and 5B, a pair of bobbins 10, 12 are spaced by a distance and rotated about longitudinal axis 45. Axis 45 is preferably parallel to axes 10', 12' and is preferably equidistant from the same. Note that an articulating jig that includes vertically and laterally articulatable arms 48 may be used to set the distance between bobbins 10, 12. Each jig includes four arms 48 pivotally connected to one another. Specifically, each arm 48 is pivotally coupled, using a pivot pin or the like, at each end thereof to an end of a respective arm to realize an articulatable parallelogram. As a result, each pivot point can travel along a respective axis (corresponding to an axis of the parallelogram) whereby the movement of one pivot point shared by two arms 48 along one axis can cause the movement of the other ends of the two arms 48 along the other axis. Thus, for example, the vertical movement of the highest pivot point when a jig is upright will cause the lateral movement of the ends of the two top arms 48 in the jig. To facilitate such action, a rotatable adjustment screw 47 (which is received in a respective nut 47') can be coupled to the highest pivot point in each jig. When each jig is positioned upright, each adjustment screw 47 is vertically oriented. The proper rotation of each adjustment screw 47 can, therefore, result in the vertical movement of the highest pivot point in each jig causing the lateral movement of the ends of the top two arms as described. In a set up according to the present invention, a longitudinally and azimuthally movable guide 50 positions wire 22 at the different grooves keeping the same mechanical tension during the winding.

Figure 6:
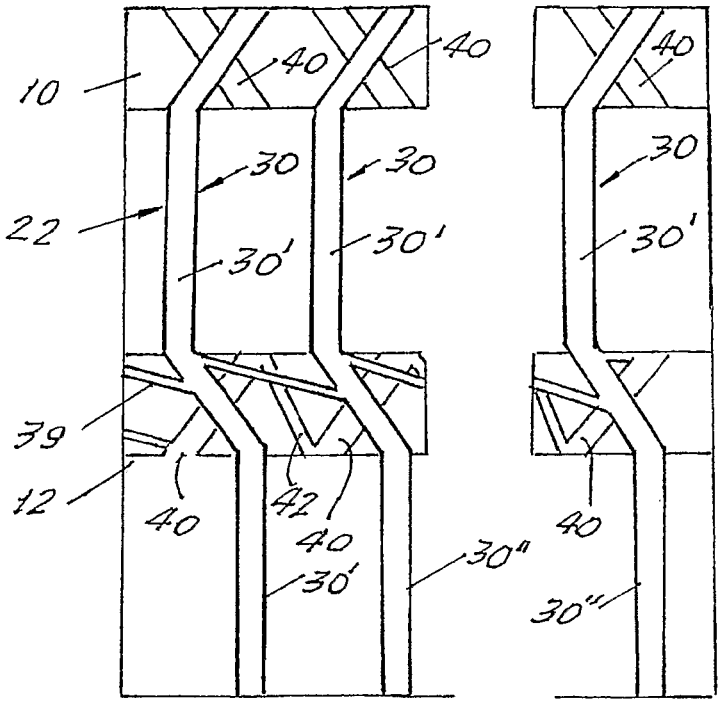
FIG. 6 shows a developed view after the first coil sections have been wound around the bobbins.

The winding process is divided into two phases. In the first phase, winding starts by feeding wire 22 to a first groove 38 through "in" groove 39 on second bobbin 12 which merges into a first groove 38 and then goes over a first groove 38 on first bobbin 10 as the bobbins 10, 12 are rotated about axis 45. Note that, according to an embodiment of the present invention, bobbins 10, 12 are first rotated counter-clockwise. By this rotation, wire 22 will be laid into grooves 38 at the outside of bobbins 10, 12. After having laid, for example, two winding layers, with two lateral windings 22' in each layer, to fill a first groove 38, wire 22 will be transported to the next groove 38 along the outer surface of bobbin 22 via connecting groove 42 between the two grooves. There, the wire is wound again in the same manner (for example, this coil section may include nine windings). This winding process is continued until the last of first grooves is provided with the desired number of windings. FIG. 6 shows the results of the winding process schematically in the developed view of the full "racetrack can" surface after the first phase winding.

Figure 7:
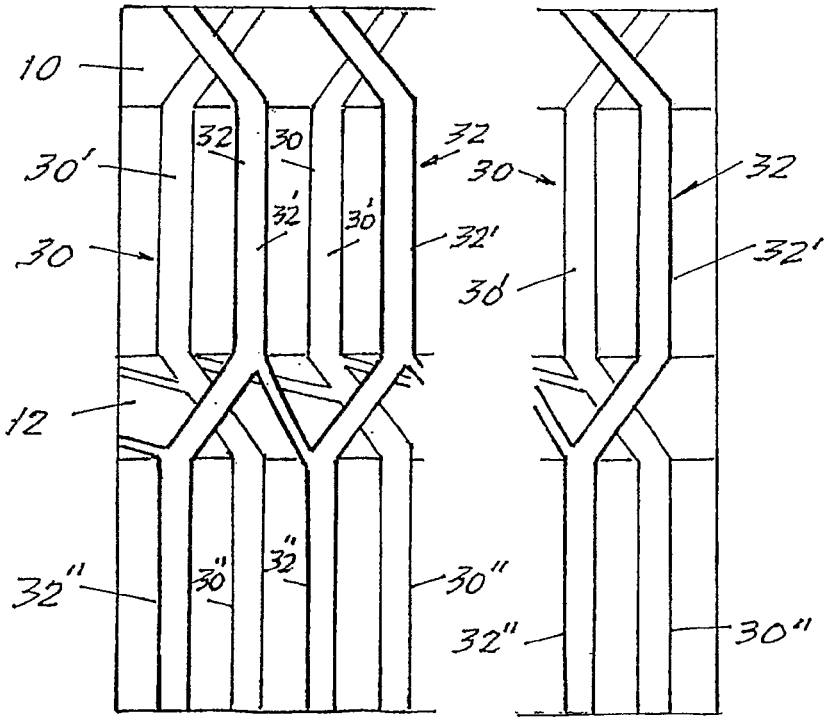
FIG. 7 shows a developed view after the second coil sections have been wound around the bobbins.

After completion of the first winding phase, wire 22 will be redirected in the opposite direction by nut 45 and return groove 44 upon a change of the sense of rotation to clockwise. Specifically, when wire 22 has arrived at groove 38 adjacent to the left of return nut 45, movable guide 50 is slid further in the direction towards the right-hand end of bobbin 12 until wire 22 is wrapped around about ⅛ of the circumference of return nut 45. Then, the sense of rotation of the assembly consisting of bobbins 10, 12 and two jigs is inverted to clockwise. The extended rim of return nut 45 will catch wire 22 and return it to groove 40 adjacent to the right of return nut 45. Then, the winding continues with the movable guide 50 coming back and moving to the left. In order to start the second phase winding, movable guide 50 is lowered by an amount equal to the diameter of a bobbin as the wire is now wound from below the bobbin pair. Then, wire 22 will be wound as before, but into grooves 40. At the end of the second phase in the process, wire 22 exits from out groove 41. The crossing area of the superconducting coils may be insulated by fiberglass (S-glass, about 70 μm) or a thin ceramic insulation (around 15 μm). In the neighborhood of the crossings, grooves 38 are deeper to facilitate the crossing of first coil sections 30. FIG. 7 shows the developed view of the second phase winding, which includes second coil sections 32. It should be noted that wire 22 could be first wound in the clockwise direction and then in the counter-clockwise direction without deviating from the scope and the spirit of the present invention. Thus, connecting grooves 42 could be included in bobbin 10 instead of bobbin 12 and the winding would start with a clockwise rotation for first coil sections 30 and change into a counter-clockwise rotation for second coil sections 32.

Thereafter, in order to position the wires as close as possible to the beam, to achieve a high magnetic field on axis, pole pieces 14, 16 are assembled. Grooves 26 of pole pieces 14, 16 fix the coils between bobbins 10, 12 and pole surfaces (i.e. surfaces adjacent grooves 26) enhance the magnetic field. Preferably, each groove 26 in each pole piece 14,16 includes a convex bottom surface to ensure that wire 22 is well fixed therein and each groove 26 is wide enough laterally to guarantee the quality of the magnetic field distribution in the space surrounding the electron beam that passes inside coil 21. Edges of grooves 26 are preferably slightly chamfered or rounded in order to facilitate insertion of wire 22 therein when pole pieces 14,16 are mounted after completion of winding. When assembling pole pieces 14,16, and bringing them as close as to form the narrow gap 15 between pole pieces 14,16, the distance between bobbins 10,12 must be decreased proportionally, which is achieved by carefully adjusting the position of adjustment screws 47 in the parallelogram jigs. The assembly will be completed by bolting additional form pieces, i.e. clamps 18,20, from outside after which the jigs can be removed.

Superconducting wire 22 must be firmly held in grooves 26 in pole pieces 14,16 as well as grooves 38,40 in first and second bobbins 10,12. Otherwise the magnet would risk quenching. That is, some parts of wire 22 may become warmer and lose superconductivity, which can entrain the whole magnet to this condition. The firm holding in grooves may require, for example, that the depth of the grooves 26 at the edge of each pole piece 14,16 that meets a groove 38,40 on a bobbin 10,12 is configured such that the superposition of a groove 26 and a groove 38,40 provides enough depth to accommodate the cross-section of a coil section. It should be noted that while it is preferred to use a single, continuous and uninterrupted superconductive wire 22 to obtain a coil 21, it may be possible, but less optimal, to use two or more such wires to obtain a coil 21. Using two separate wires, one would need four transitions from low to room temperature instead of two as is the case with the preferred embodiment. These transitions are technically weak parts and important sources of thermal load, and are, therefore, less optimal. However, the use of two or more superconducting wires may still be a variation within the scope of the present invention.

FIG. 8 graphically illustrates a simulated magnetic field distribution along the midplane of a miniundulator according to the present invention. Note that the data that is graphically shown was calculated by means of RADIA at a current density of 1000 A/mm2 corresponding to 70% of critical density.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A miniundulator, comprising:

a first bobbin having a first longitudinal axis;

a second bobbin spaced from said first bobbin and having a second longitudinal axis; and a superconductive wire wound around outer surfaces of said first bobbin and said second bobbin to define a single coil having a plurality of coil sections arranged along said first and said second longitudinal axes.

2. The miniundulator of claim 1, wherein said coil sections include a first coil section lying along a first plane that intersects said first longitudinal axis and said second longitudinal axis at an angle other than 90 degrees, and a second coil section lying along a second plane that intersects said first longitudinal axis and said second longitudinal axis at an angle other than 90 degrees, wherein said first plane and said second plane intersect one another, and said first coil section and said second coil section cross one another on said outer surfaces of said first bobbin and said second bobbin.

3. The miniundulator of claim 1, wherein said coil sections include a first group of first coil sections each lying along a respective first plane that intersects said first longitudinal axis and said second longitudinal axis at an angle other than 90 degrees, and a second group of second coil sections each lying along a second plane that intersects said first longitudinal axis and said second longitudinal axis at an angle other than 90 degrees, wherein each said first coil section crosses a respective second coil section on said outer surfaces of said first bobbin and said second bobbin.

4. The miniundulator of claim 1, wherein said coil sections include a first coil section lying along a first plane that intersects said first longitudinal axis and said second longitudinal axis at an angle other than 90 degrees, and a second coil section lying along a second plane that intersects said first longitudinal axis and said second longitudinal axis at an angle other than 90 degrees, wherein said first coil section and said second coil section cross one another on said outer surfaces of said first bobbin and said second bobbin, and wherein each said coil section includes a top portion lying on a top plane and a bottom portion lying on a bottom plane that is parallel to said top plane, said top sections being parallel to one another and said bottom sections being parallel to one another.

5. The miniundulator of claim 4, wherein said top portion of said first coil section is disposed above said bottom portion of said second coil section and said top portion of said second coil section is disposed above said bottom portion of said first coil section.

6. The miniundulator of claim 1, wherein said coil sections include first group of first coil sections each lying along a first plane that intersects said first longitudinal axis and said second longitudinal axis at an angle other than 90 degrees, and a second group of second coil sections each lying along a second plane that intersects said first longitudinal axis and said second longitudinal axis at an angle other than 90 degrees, wherein each said first coil section crosses a respective said second coil section on said outer surfaces of said first bobbin and said second bobbin, and wherein each said coil section includes a top portion lying on a top plane and a bottom portion lying on a bottom plane that is parallel to said top plane, said top sections being parallel to one another and said bottom sections being parallel to one another.

7. The miniundulator of claim 6, wherein said top portion of each said first coil section is disposed above said bottom portion of said respective second coil section and said top portion of said respective second coil section is disposed above said bottom portion of said first coil section.

8. The miniundulator of claim 1, wherein at least one of said bobbins includes a bore in the body thereof configured for the reception of a cooler.

9. The miniundulator of claim 8, wherein said cooler is a cooling fluid.

10. The miniundulator of claim 9, wherein said cooling fluid comprises liquid helium.

11. The miniundulator of claim 8, wherein said cooler comprises a copper body thermally coupled to a cooling source.

12. The miniundulator of claim 1, wherein said superconductive wire comprises a superconductive material that can be one of a high $T_c$ superconductive material, or NbTi, or $Nb_3Sn$.

13. The miniundulator of claim 12, wherein said superconductive wire includes a rectangular cross-section.

14. The miniundulator of claim 1, wherein each coil section comprises a plurality of windings, said windings being arranged in layers, wherein each layer includes a plurality of laterally arranged windings.

15. The miniundulator of claim 1, further comprising a plurality of pole pieces, said pole pieces being arranged opposite one another, in contact with said coil sections, and extending between said first bobbin and said second bobbin, wherein said pole pieces and said bobbins define a space in the interior of said coil sections configured for the passage of a beam.

16. The miniundulator of claim 15, further comprising a plurality of clamps securing said pole pieces around said bobbins.

17. The miniundulator of claim 15, wherein each said pole piece includes a plurality of grooves each for receiving a portion of a coil section.

18. The miniundulator of claim 15, wherein said pole pieces and said bobbins define a beam cavity for the passage of a beam, said beam cavity including a first dimension defined by the distance between said bobbins and a second dimension defined by a distance between said pole pieces, wherein said second dimension is less wide than thickness of said bobbins.

19. The miniundulator of claim 1, wherein at least one of said bobbins includes a plurality of guiding grooves on the outer surface that receives a portion of a respective coil section.

20. A method for assembling a miniundulator, comprising:

positioning a first bobbin and a second bobbin parallel to one another by a distance; and defining a single coil around outer surfaces of said first bobbin and said second bobbin by winding a superconductive wire over the outer surfaces of said first bobbin and said second bobbin by rotating said first and said second bobbin about a common axis; and moving said wire in a direction parallel to said common axis while rotating said bobbins.

21. The method of claim 20, wherein at least one of said bobbins includes guiding grooves on said outer surface thereof, said wire being received in and aligned by said guiding grooves.

22. The method of claim 20, wherein said bobbins are rotated counter-clockwise to obtain a plurality of first coil sections aligned parallel to a plane that lies along a first direction, and rotated in a clockwise direction to obtain a plurality of second coil sections aligned parallel to a plane that lies along a second direction, wherein each said first coil section is crossed by a respective second coil section.

23. The method of claim 22, wherein said wire is a continuous, uninterrupted wire.

24. The method of claim 20, wherein said first bobbin and said second bobbin are positioned by said distance with a jig.

* * * * *